US008075172B2

(12) United States Patent
Davey et al.

(10) Patent No.: US 8,075,172 B2
(45) Date of Patent: Dec. 13, 2011

(54) DURABLE SUPER-COOLED INTELLIGENT LIGHT BULB

(75) Inventors: George Davey, West Des Moines, IA (US); Mike Pieper, Wever, IA (US)

(73) Assignee: A66, Incorporated, Wilmington, DE (US)

( * ) Notice: Subject to any disclaimer, the term of this patent is extended or adjusted under 35 U.S.C. 154(b) by 205 days.

(21) Appl. No.: 11/811,059

(22) Filed: Jun. 8, 2007

(65) Prior Publication Data

US 2008/0304249 A1 Dec. 11, 2008

(51) Int. Cl.
*F21V 29/00* (2006.01)
*F21V 21/00* (2006.01)

(52) U.S. Cl. ... 362/554; 362/580; 362/373; 362/249.05; 362/249.06

(58) Field of Classification Search ..... 362/249.01–249.19, 294, 580, 362/373, 554–556, 551, 511, 650, 363, 809, 362/545; 313/500, 512
See application file for complete search history.

(56) References Cited

U.S. PATENT DOCUMENTS

| | | | | |
|---|---|---|---|---|
| 6,220,722 | B1 * | 4/2001 | Begemann | 362/231 |
| 6,520,669 | B1 | 2/2003 | Chen et al. | |
| 6,528,954 | B1 | 3/2003 | Lys et al. | |
| 6,582,115 | B2 * | 6/2003 | Huang | 362/565 |
| 7,075,226 | B2 | 7/2006 | Cok | |
| 2001/0014019 | A1 * | 8/2001 | Begemann | 362/231 |
| 2003/0048632 | A1 * | 3/2003 | Archer | 362/101 |
| 2003/0112639 | A1 * | 6/2003 | Stack | 362/552 |
| 2005/0105302 | A1 * | 5/2005 | Hofmann et al. | 362/555 |
| 2005/0174769 | A1 * | 8/2005 | Yong et al. | 362/235 |
| 2007/0263381 | A1 * | 11/2007 | Goldman et al. | 362/183 |

* cited by examiner

*Primary Examiner* — Thomas Sember
(74) *Attorney, Agent, or Firm* — Brown Winick Law Firm

(57) ABSTRACT

A self cooling light effects device for use in a standard light bulb socket having a socket adaptor, surface embedded LEDs for generating light effects, controllable light effects, and various ways for cooling. Fiber optic cables provide further light effects. Controlling light effects may include a logic board. Cooling may be accomplished by any combination of fans, heat sinks, heat pipes, thermoelectric cooling, a heat conductive filler, and a heat conductive housing.

36 Claims, 6 Drawing Sheets

DURABLE SUPER-COOLED INTELLIGENT LIGHT BULB

BACKGROUND OF THE INVENTION

1. Field of Invention

The present invention is related to light sources in general and, more particularly, to light sources wherein the source can be controlled to emit light according to the user's preferences and achieves greater durability through the addition of cooling and self-repair features.

2. Description of Prior Inventions

The common light bulb used in most households comprise threads at a narrower portion for inserting and securing in connection with a power source, a filament through which electricity is conducted and light is produced, a glass bulb filled with an inert gas or vacuum through which the light is emitted. This light bulb is very inexpensive and has enjoyed popular status for nearly 120 years. However, it is fragile in that the glass outer bulb breaks fairly easily. In addition, it is not highly durable since it "burns" out fairly quickly. The bulb becomes quite hot which limits not only its lifetime but its applications, as well.

Other light sources have been developed including lights employing fluorescent tubes, and neon lights. Because fluorescent lights contain mercury, the lights can be a health hazard. Further, light emitting diodes and organic light emitting diodes have been developed and are used in a variety of lighting applications. More recent developments include light sources comprising an array of light emitting diodes (LEDs) mounted on a substrate. These are sometimes employed in the automotive industry as they can be mounted on curved surfaces or on a substrate that is flexible. Some applications of an array of LEDs include the ability to independently light certain diodes relative to others, mixing colors of lights, etc. See, for example, U.S. Pat. Nos. 6,520,669 and 7,075,226.

In addition to the on-off modes for most light bulbs, the more sophisticated light sources may include controllers so that a light 'show' can be provided. Other more mundane applications of a controlled light source may include varying wavelengths, of emitted light, dimming or brightening, and on-off. See for example U.S. Pat. Nos. 6,520,669; 6,050,702. Different wavelength of light are commonly referred to as color temperature derived from the wavelength associated with black body radiation.

Although many different ways exist to provide light, some problems are prevalent and certain challenges continue to exist. For example, the lifetimes of many light sources are relatively short. Some of the life expectancy issues are due to the lack of heat dissipating mechanisms in the source. Others are due to the fragility of the materials with which the sources are made.

What was needed was a light source that included cooling features allowing the light source to expand its life expectancy beyond that of other standard bulbs. Further, a light source that included means of wireless control of color temperature or color patterns was desirable. Moreover, a light source that could replace the typical household bulb that included a much extended light life as well as a more durable construction was desired. Finally, a light source that could serve as a multi-purpose appliance by allowing high-powered light use on demand or serving as a wireless internet router was also desirable.

The first objective of the present invention is to replace the 'glass bulb' model with a source wherein the basic structure was of material far stronger than glass;

The second objective is to provide a light source wherein the source can be wirelessly controlled to provide any of a wide range of colored light;

The third objective is to provide a light source using the highly adaptable LED to provide the light;

The fourth objective is to provide a light source wherein the heat generated is dissipated in such a way as to allow the source a longer lifetime;

The fifth objective is to provide a controllable light source wherein the light source could be in the form of a standard light bulb yet be controlled wirelessly without the appearance and presence of an outer controller;

The sixth objective is to create a light source that can function as a high power source as well as a standard light source;

The seventh objective is to create a light source with multiple functions such as serving as a wireless internet router; and The eighth objective is to create a bulb with built in emergency lighting and fiber optic transmission of light.

SUMMARY

The present invention is a self cooling light effects device having an adaptor for use in a standard light bulb socket. A surface of a housing with an upper portion is embedded with LEDs serving as means to generate light effects. The device further includes means to control light effects and means for cooling. Fiber optic cables and an associated light source provide further means for generating light effects.

Means to control light effects may include an electronic circuit and a logic board. The logic board is programmable for different light effects and may be removed and upgradeable. Including a wireless adaptor allows the logic board to be updated or controlled by any computer system via a preprogrammed web browser based interface.

Means for cooling may be any combination of fans, heat sinks, heat pipes, thermoelectric cooling, and a heat conductive filler. Use of a fan requires one or more apertures in the housing. The housing is preferably made of a heat conductive material to aid in the transfer of heat from heat sinks or filler. Because the logic board is the most likely source of excess heat, it is preferable that means for cooling be conductively associated with the logic board. Heat can also be transferred to the housing or outside of the housing via a heat pipe.

Other objects, features, and advantages of the present invention will be readily appreciated from the following description. The description makes reference to the accompanying drawings, which are provided for illustration of the preferred embodiment. However, such embodiment does not represent the full scope of the invention. The subject matter which the inventor does regard as his invention is particularly pointed out and distinctly claimed in the claims at the conclusion of this specification.

DESCRIPTION OF THE PREFERRED EMBODIMENT(S)

Figure 1:
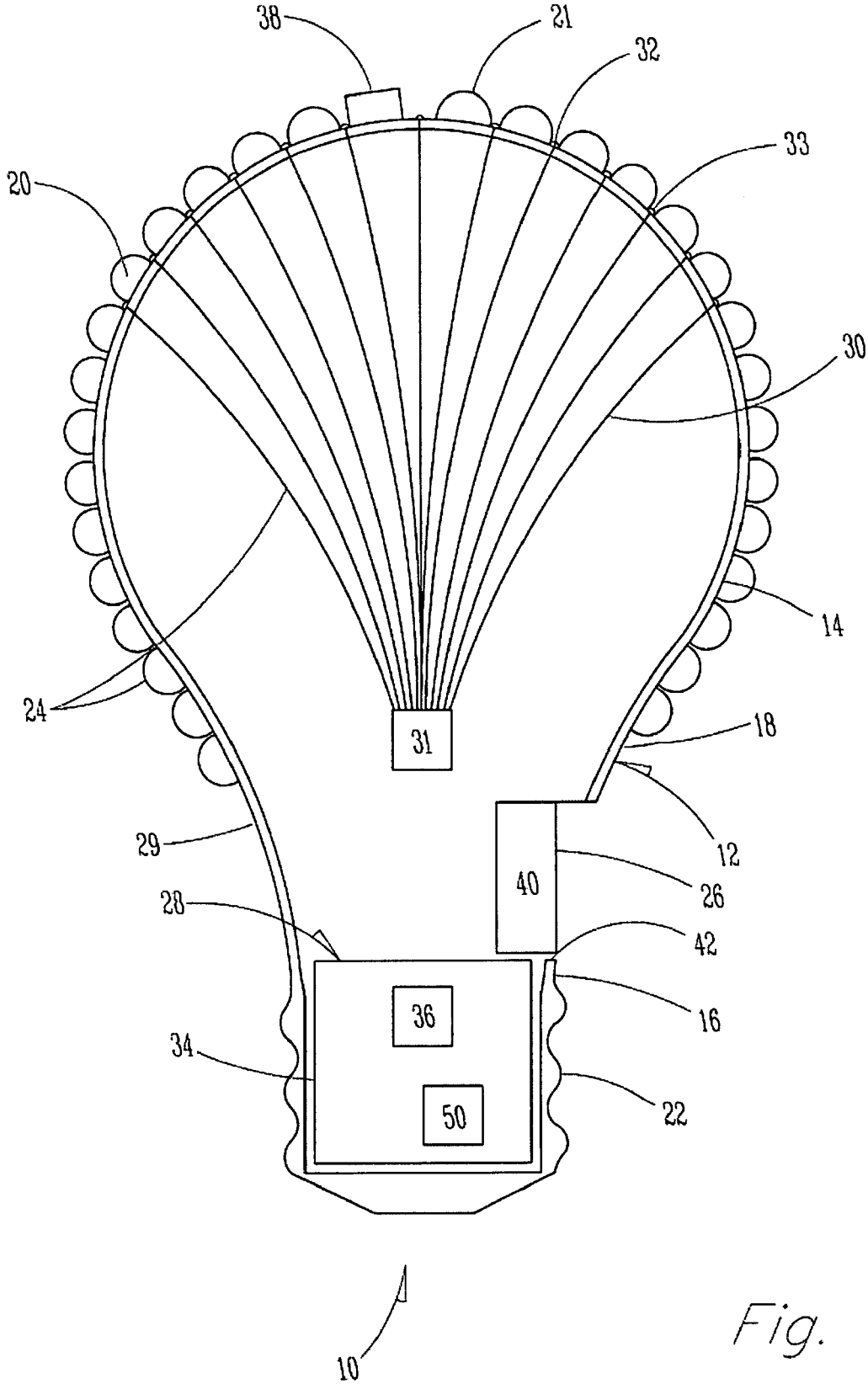
FIG. 1 is an elevated cross-sectional view of a first preferred embodiment of the present invention.

The present invention is a self cooling light effects device 10 formed to serve as a replacement for a standard light bulb. As shown in FIG. 1, The device 10 has a housing 12 preferably sized and shaped similar to a standard light bulb, but the housing 12 can be of any shape well disposed to its purpose. The housing 12 has an upper portion 14 and a lower portion 16. An exterior surface 18 of the housing 12 is embedded with a plurality of light emitting diodes ("LEDs") 20. The LEDs may be surface mounted ("SMT LEDs"). If used, each of the SMT LEDs may include an optical diffuser 21 to provide maximum performance. An adaptor 22 is associated with the lower portion 16 and this adaptor 22 allows the device 10 to fit into an existing light bulb socket (not shown) and receive electrical power. The device 10 includes several features that enhance its usefulness, durability, and longevity. These features are means for generating light effects 24, means for cooling 26, and means for controlling light effects 28.

The LEDs 20 may be embedded in the exterior surface 18 of the housing 12. Alternatively, as shown in FIG. 1, the LEDs 20 may be embedded in a skin 29 that is wrapped around the upper portion 14 of the housing 12. Embedding LEDs 20 in the skin 29 is advantageous for manufacturing the device 10, but for the function of the device 10, it is only necessary that the LEDs 20 be affixed to the housing 12 to emit light away from the housing 12.

The number of LEDs 20 depend upon the desired lumens to be produced by the device 10. Means for generating light effects 24 necessarily includes the LEDs 20. For this reason, the LEDs 20 are preferably a mixture LEDs producing light of various wavelengths. The number and diversity of LEDs 20 will correspond to the number and diversity of lighting effects that can be produced by the device 10. The preferred means for generating light effects 24 also includes a plurality of illuminated fiber optic cables 30 extending from within said housing 12 to said exterior surface 18 of said housing 12. The fiber optic cables 30 are preferably illuminated by a light source 31 within said housing 12. In all preferred embodiments, a translucent or generally transparent film overlays means for generating light effects 24 to provide additional protection.

To transmit light from the fiber optic cables 30 through the housing 12, the housing 12 defines a plurality of holes 32 and each of the cables 30 is positioned to emit light from one of said holes 32. It is preferable that each of the cables 30 terminate with an optical diffuser lens 33. In the preferred embodiment, each diffuser lens 33 serves to anchor each of the cables 30 to the housing 12. Also in the preferred embodiment, the diameter of the holes are about 0.015 to about 0.025 inches and the fiber optic cables 30 terminate into diffuser lenses 33 having a diameter of 0.040 inches. It should be understood that the holes 32 and the diffuser lenses 33 may be of any diameter consistent with the diameter of the fiber optic cables 30.

The LEDs 20, light source 31, and any other means for generating light effects 24, such as, for example, a laser, are controlled by means for controlling light effects 28. The preferred means 28 includes an electronic circuit 34 having a logic board 36. The logic board 36 is programmable with at least one light effects program. In executing the at least one light effects program, the logic board 36 controls the activation of each of said LEDs 20, said light source 31, and/or other mean for generating light effects 24. The logic board 36 can execute any number of programs limited only by the number of possible light effects.

In a first embodiment, referring again to FIG. 1, the means for controlling light effects 28 includes a light sensor 38 mounted on the exterior surface 18 of the housing 12. The light sensor 38 measures the level of light exterior to the housing 12 and the logic board 36 is programmed to activate a number of LEDs 20 related to the level of ambient light. In this first embodiment, the device 10 is useful in maintaining a consistent level of light within a room despite changing ambient light conditions, such as during the course of a day when a room may receive varying levels of sunlight.

Components of the device 10 such as the electronic circuit 34 and its connections to other components, the logic board 36, the light source 31, and the adaptor 22 produce heat. Excess heat increases the failure rate and lowers the longevity of light sources including the device 10. To decrease the amount of heat, the device 10 includes means for cooling 26 to remove heat from within the housing 12. Means for cooling 26 in the first embodiment includes a fan 40 mounted inside the housing 12. The fan 40 exchanges heated air from within the housing 12 with cooler air outside of the housing 12. To assist in transferring heat, the housing 12 of the first embodiment defines an aperture 42. It should be understood that the housing can include any number of fans and apertures necessary to sufficiently cool the device 10.

Figure 2:
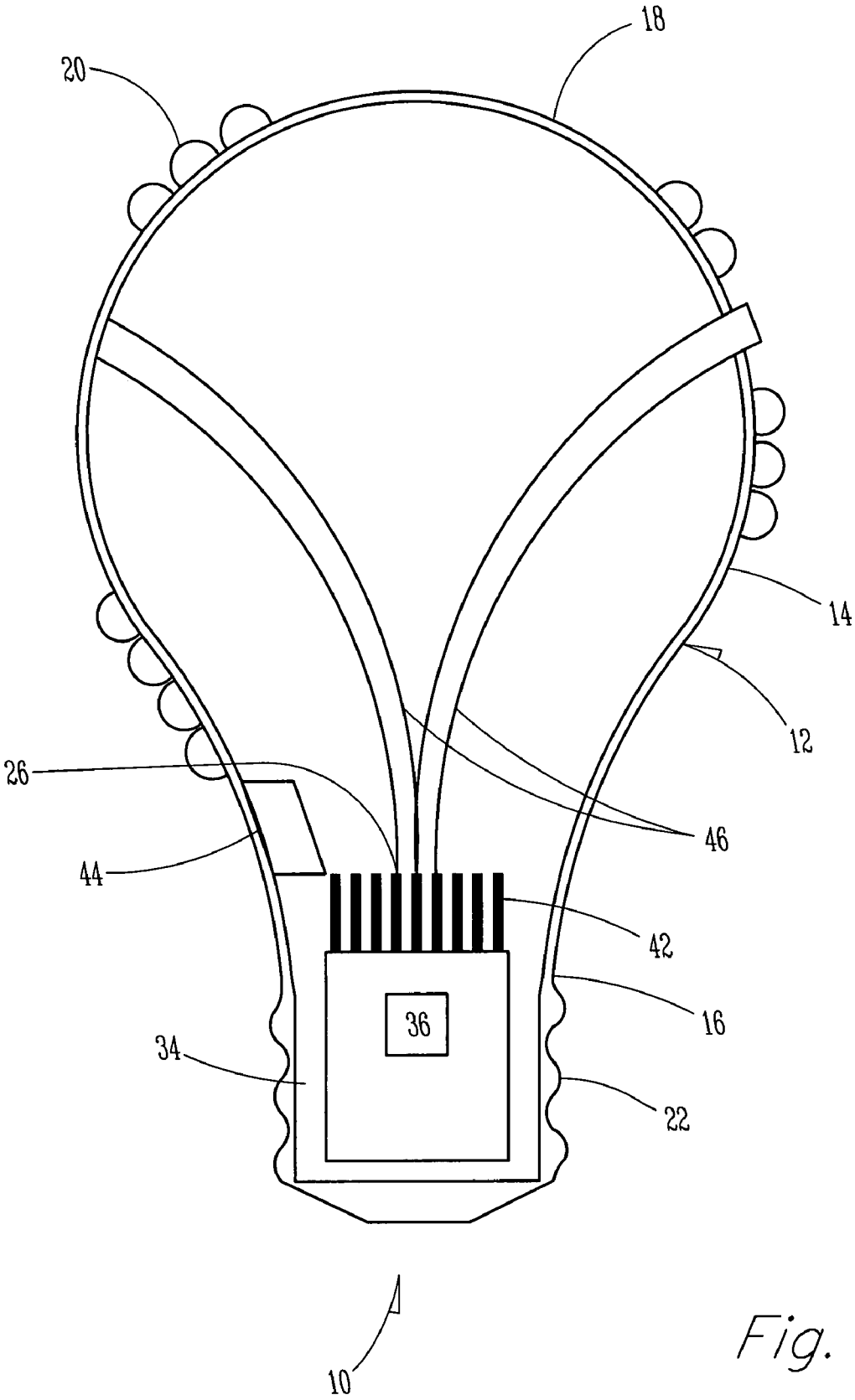
FIG. 2 is an elevated cross-sectional view of a second preferred embodiment of the present invention.

In a second embodiment of the preferred invention, shown in FIG. 2, means for cooling 26 includes a heat sink 42, a thermoelectric device 44, and a plurality of heat pipes 46. The thermoelectric device 42 is preferably associated with the housing 12 and the heat sink 26 is preferably associated with the logic board 36 to cool the logic board 36 and transfer heat outside of the housing 12. The heat pipes 46 are also preferably associated with the heat sink 42 and the housing 12 to transfer heat from the heat sink 42 to the housing 12. To further aid in the transfer of heat, it is preferable that the housing 12 be composed of a heat conducting material such as a metal. Aluminum and copper are two such metals known to excel in the conduction of heat. Heat transferred to the preferred housing 12 will dissipate from the housing. It is further preferable that one of the heat pipes 46 extend beyond the exterior surface 18 of the housing 12. This exterior extending heat pipe 46 may be utilized in transferring heat to an exterior heat sink. For example, the metal parts of a lamp holding the device 10 may be used to transfer heat from the heat pipe 46 to surrounding air.

Figure 3:
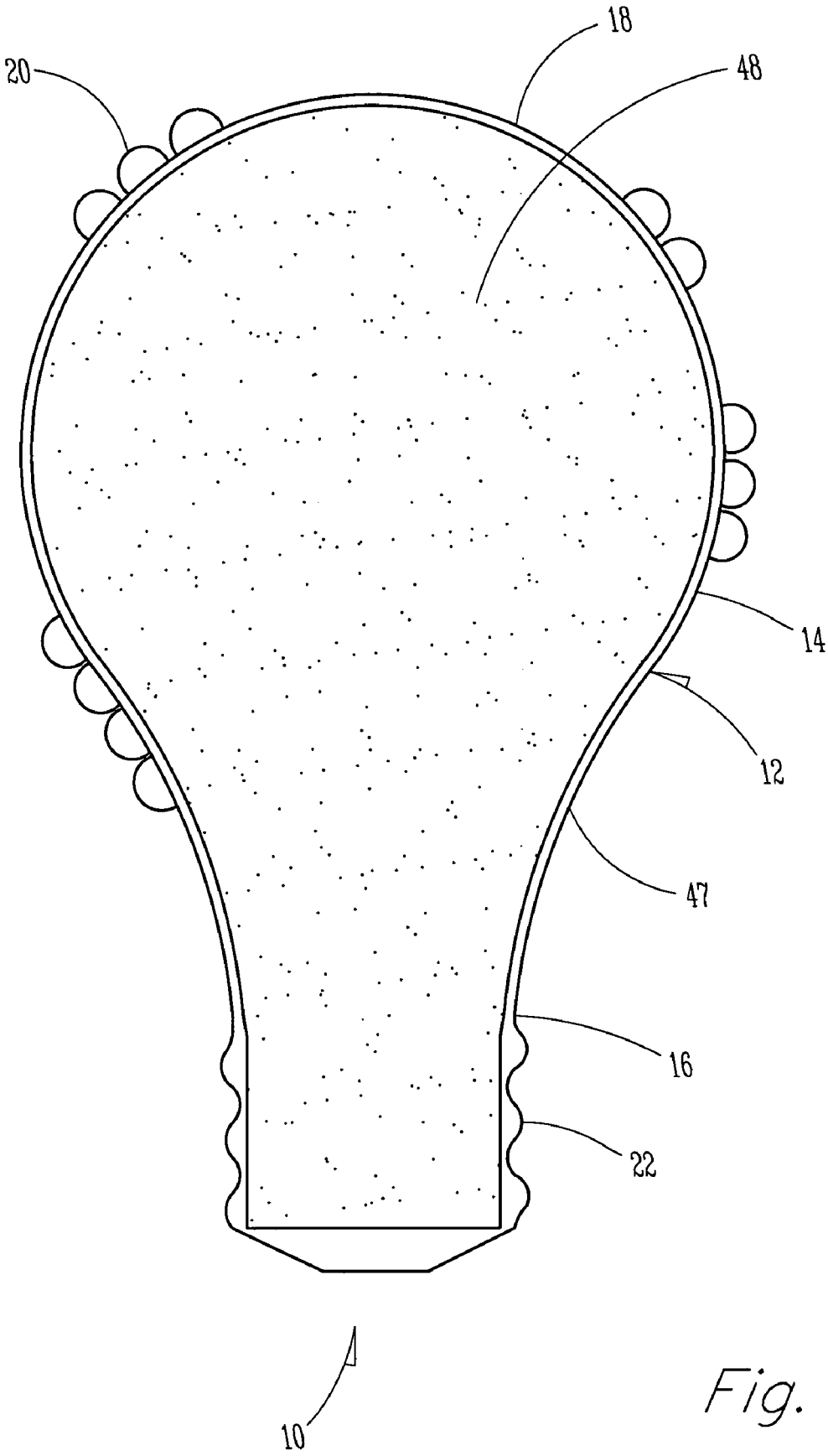
FIG. 3 is an elevated cross-sectional view of a third preferred embodiment of the present invention.

In a third embodiment of the preferred embodiment, shown in FIG. 3, means for cooling 26 includes a heat conductive filler 48 inside the housing 12. It is also preferable in this embodiment that the housing 12 be composed of a heat conducting material. The filler 48 may be any type of heat conductive material. Copper fiber is an example of an adequate filler as is liquid fluid or heat conductive granules. It is preferable that the filler 48 fill the housing 12 such that there does not remain more than an insubstantial volume of unfilled space. It is preferred to employ a barrier 47 to retain the filler within the housing 12. The barrier 47 of the preferred embodiment is an insulating non-conductive paint.

Referring again to the first embodiment in FIG. 1, It is also preferable, however, that the logic board 36 be removably attached to the circuit 34. The logic board 36 can be removed from the circuit 34 to add programming or to swap logic boards having different programming. Means for controlling light effects 28 is also further enhanced by inclusion of a wireless network adaptor 50 on the logic board 36. The adaptor 50 may also, and alternatively, have a wired connection.

New light effect programs can be transmitted to the adaptor 50 for upgrading the logic board 36 and increasing the functionality of the device 10.

Figure 4:
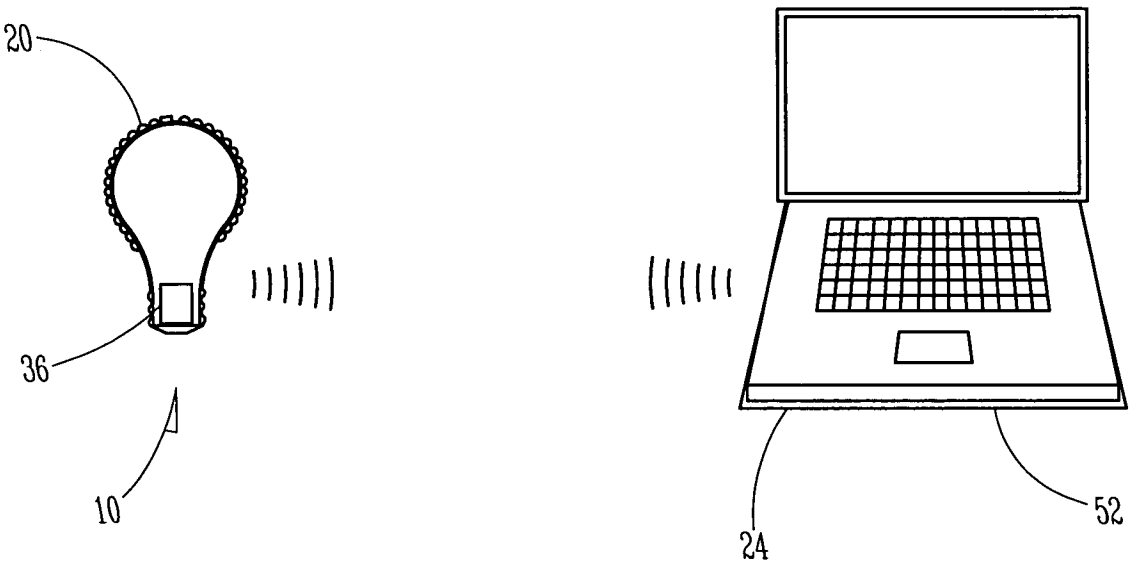
FIG. 4 is a plan view of the first preferred embodiment of FIG. 1 in wireless communication with an external computer.

In the first preferred embodiment seen in FIG. 4, a computer 52 wirelessly communicates with the logic board 36. It should be noted that any computer with wireless communication capabilities can serve as the computer 52. In this manner, means to control lighting effects 28 also includes the computer 52 to provide unlimited control of means to generate lighting effects 24 without replacing or reprogramming the logic board 36. Also in the first preferred embodiment, the logic board 36 is preprogrammed with a web browser based interface. The computer 52 need only connected to the internet protocol address of device 10 in order to configure the device 10 and introduce new light effects programs.

Figure 5:
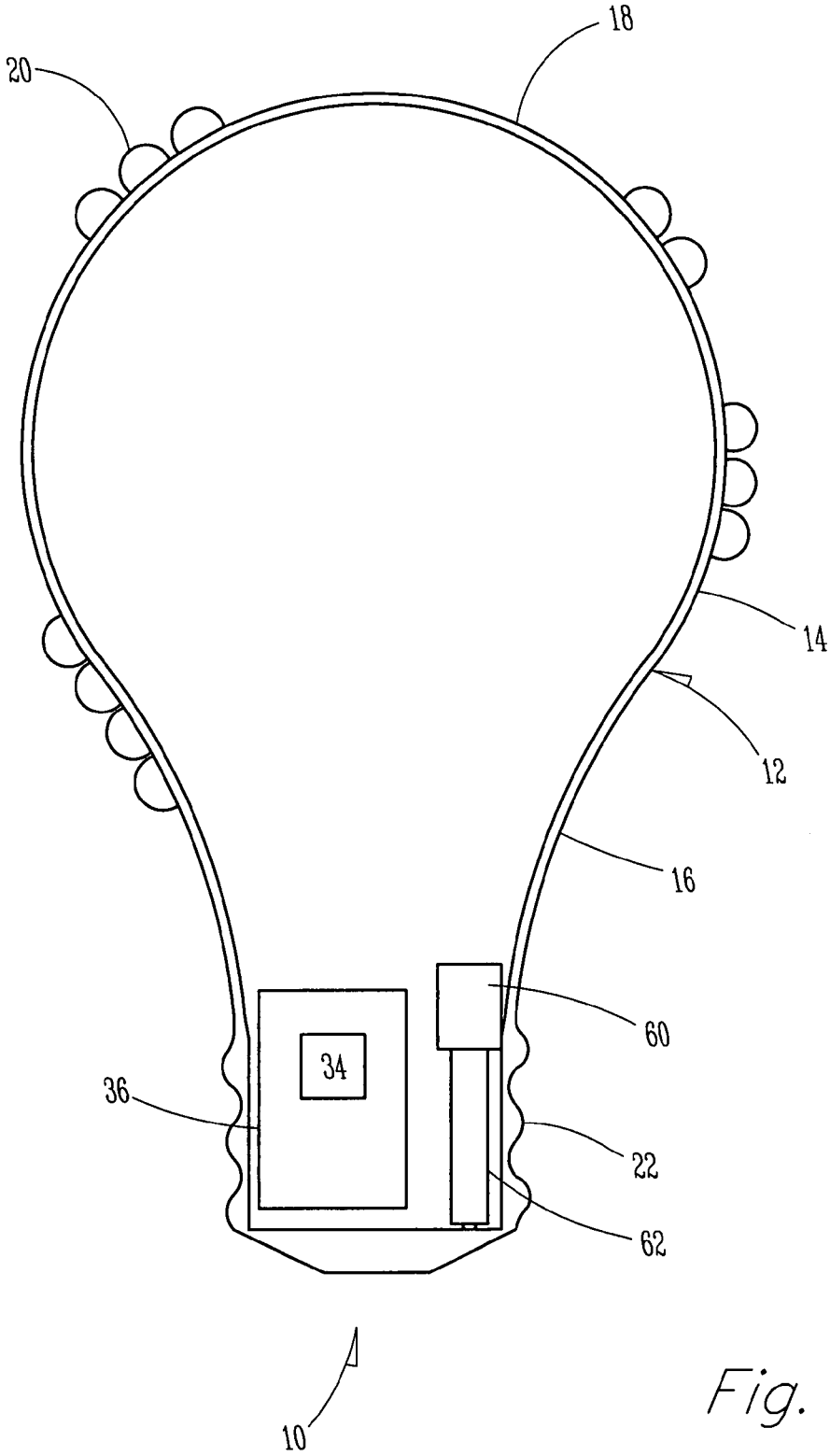
FIG. 5 is an elevated cross-sectional view of a fourth preferred embodiment of the present invention.
Figure 6:
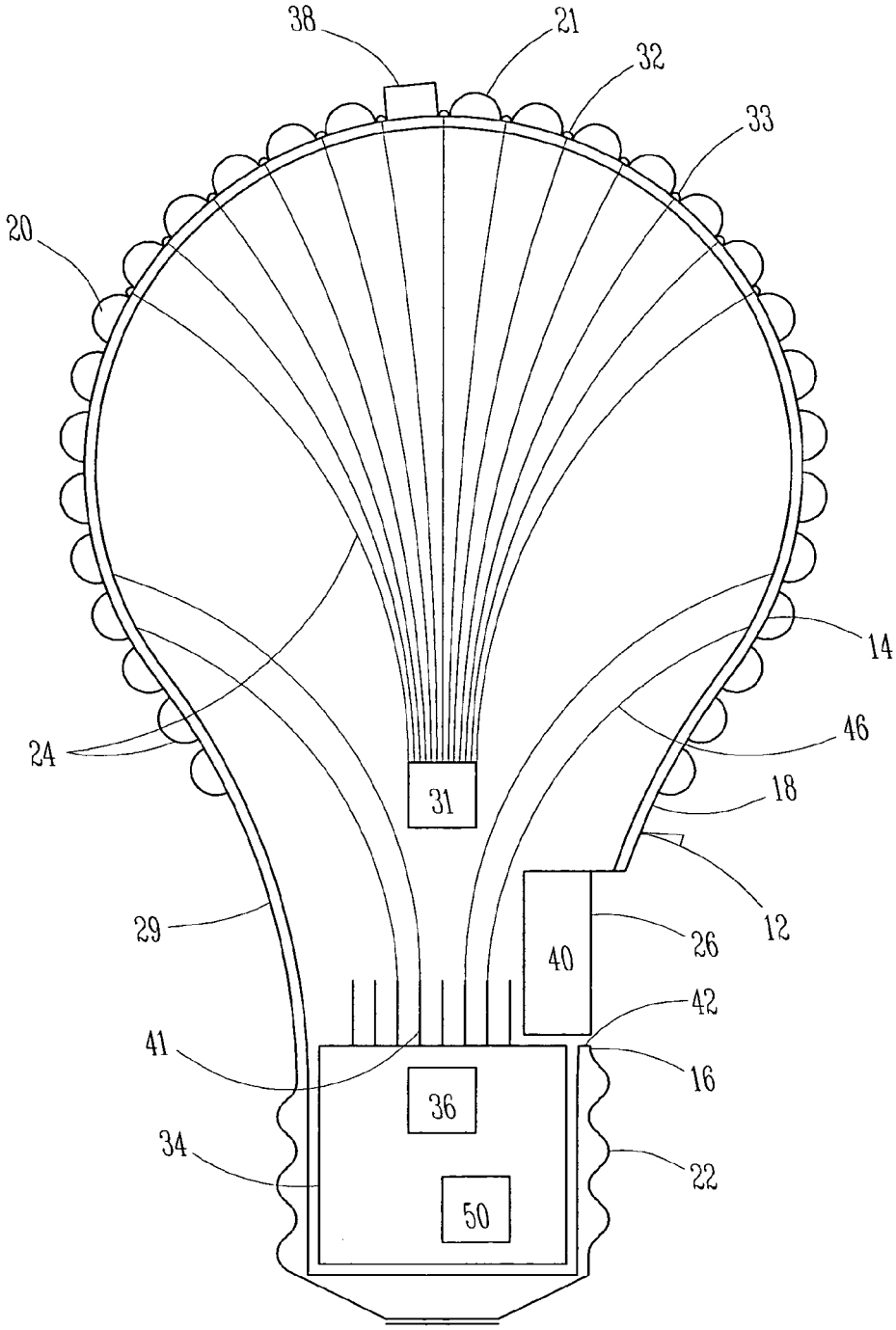
FIG. 6 is an elevated cross-sectional view of a fifth preferred embodiment of the present invention.

In a fourth preferred embodiment shown in FIG. 5, the device 10 may also be useful in providing emergency lighting. Power is ordinarily provided by the light socket, but in certain situations it is advantageous to provide an alternative power source for the device 10, such as, for example, during a blackout. In the fourth preferred embodiment, an electronic circuit 60 and a battery 62 serve as means for providing emergency lighting independent of the light socket. The electronic circuit 60 is connected to the battery 62 and the light socket to switch power to the battery 62 when power is not provided by the socket. It is preferable that the battery 62 be rechargeable, possibly by the socket itself, such that the battery 62 need not be actively maintained in order to ensure back-up power for the device 10. The circuit 34 may also serve as electronic circuit 60.

Thus, the present invention has been described in an illustrative manner. It is to be understood that the terminology that has been used is intended to be in the nature of words of description rather than of limitation. Many modifications and variations of the present invention are possible in light of the above teachings. For example, the various means for cooling 26 may supplement each other or stand alone. Therefore, within the scope of the appended claims, the present invention may be practiced otherwise than as specifically described.

What we claim is:

1. A self cooling light effects device for use in a light bulb socket providing power comprising:

a) a housing having an exterior surface, an upper portion, and a lower portion;

b) a plurality of LEDs surrounding said upper portion of said housing;

c) an adaptor associated with said lower portion of said housing and formed to electrically and frictionally engage said light bulb socket;

d) means for cooling said device;

e) means for generating light effects, wherein said light effects generating means includes:

i) a plurality of fiber optic cables extending from within said housing to said exterior surface of said housing;

ii) and a light source associated with said plurality of fiber optic cables within said housing, wherein said housing defines a plurality of holes, each of said holes associated with each of said plurality of fiber optic cables to transmit light from said light source through said housing; and f) a wireless interface for controlling light effects incorporated in said device.

2. The device of claim 1 wherein said housing defines at least one aperture through said exterior surface and said means for cooling includes at least one fan for transferring air through said at least one aperture.

3. The device of claim 2 wherein said fan is mounted inside said housing.

4. The device of claim 2 wherein said at least one fan is mounted on the exterior surface of said housing.

5. The device of claim 1 wherein said means for cooling includes at least one heat sink.

6. The device of claim 5 wherein said means for cooling includes a plurality of heat sinks.

7. The device of claim 6 wherein said means for cooling includes a plurality of heat pipes conductively associated with each of said plurality of heat sinks and extending to said housing.

8. The device of claim 7 wherein said housing is composed of a heat conductive material.

9. The device of claim 7 wherein said heat pipes extend through said exterior surface to transfer heat from said device.

10. The device of claim 1 wherein said means for cooling includes a heat conductive filler inside of said housing.

11. The device of claim 10 wherein said filler is copper fiber, a liquid fluid, or a heat conducting granule.

12. The device of claim 11 wherein said housing is composed of a heat conducting material.

13. The device of claim 12 wherein said housing does not include more than an insubstantial volume of unfilled space.

14. The device of claim 10 wherein said filler is surrounded by a barrier to retain said filler within said housing.

15. The device of claim 1 wherein said cooling means includes a thermoelectric cooling device associated with said means for controlling light effects.

16. The device of claim 1 wherein said cooling means includes said housing and said housing is composed of a heat conducting material.

17. The device of claim 16 wherein said heat conducting material includes a metal.

18. The device of claim 17 wherein said heat conducting material is copper or aluminum.

19. The device of claim 1 wherein said plurality of LEDs are embedded in said exterior surface on said upper portion of said housing.

20. The device of claim 1 wherein said device includes a skin surrounding said upper portion of said housing and said plurality of LEDs are embedded in said skin.

21. The device of claim 1 wherein said plurality of LEDs are SMT LEDs.

22. The device of claim 21 wherein each of said plurality of LEDs includes an optical diffuser.

23. The device of claim 1 wherein each of said plurality of fiber optic cables includes an optical diffuser at its terminus in proximity to said plurality of holes, each of said optical diffusers attaching each of said fiber optic cables to said housing.

24. The device of claim 23 wherein the diameter of each of said holes is about 0.015 to about 0.025 inches and the diameter of said optical diffuser is about 0.40 inches.

25. The device of claim 1 wherein said device further comprises means for providing emergency lighting independent of power provided by said socket.

26. The device of claim 25 wherein said means for providing emergency lighting comprises a battery for powering said device.

27. The device of claim 26 wherein said battery is rechargeable and said means for providing emergency lighting includes an electronic circuit for switching power to said battery when power is not provided by said socket.

28. The device of claim 1 wherein said means for controlling light effects includes an electronic circuit inside said housing and connected to said means for generating light effects.

29. The device of claim 28 wherein said electronic circuit includes a logic board for storing and executing at least one light effects program.

30. The device of claim 29 wherein said logic board is removably attached to said electronic circuit.

31. The device of claim 29 wherein said electronic circuit includes a wireless adaptor providing said logic board with wireless communication.

32. The device of claim 31 wherein said means for controlling light effects includes a computer in wireless communication with said logic board.

33. The device of claim 32 wherein said logic board includes a preprogrammed web browser based interface accessible by said computer.

34. The device of claim 29 wherein said means for controlling light effects includes a light sensor located on said exterior surface of said housing for sensing light levels and said logic board is adapted to communicate with said light sensor for maintaining a constant ambient light around said device.

35. The device of claim 1 further comprising a logic board inside said housing, wherein said housing is formed of a heat conductive material and said means for cooling includes:

a) a heat sink conductively associated with said logic board; and b) a heat pipe conductively associated with said heat sink and extending to said exterior surface of said housing to transfer heat from said logic board to said exterior surface.

36. The device of claim 35 wherein said housing defines an aperture through said exterior surface and said means for cooling further includes a fan mounted inside said housing for transferring air through said aperture.

* * * * *